US005283080A

United States Patent [19]

Lamb et al.

[11] Patent Number: 5,283,080

[45] Date of Patent: Feb. 1, 1994

[54] METHOD AND APPARATUS FOR MANUFACTURING A GRANULE-COVERED ROOFING MATERIAL BY MODIFYING A PROCESS PARAMETER IN RESPONSE TO MEASURED REFLECTED LIGHT

[75] Inventors: Glenn D. Lamb, Granville; David R. Rodenbaugh, Baltimore, Lawrence J. Grubka, Heath; all of Ohio

[73] Assignee: Owens-Corning Fiberglas Technology Inc., Summit, Ill.

[21] Appl. No.: 912,365

[22] Filed: Jul. 10, 1992

[51] Int. Cl.[5] ..... B05D 1/12; B05C 19/04

[52] U.S. Cl. ..... 427/8; 427/186; 427/202; 427/365; 118/119; 118/308; 118/665; 118/672; 118/712

[58] Field of Search ..... 427/8, 186, 187, 202, 427/365; 118/308, 665, 672, 119, 712

[56] References Cited

U.S. PATENT DOCUMENTS

| | | | |
|---|---|---|---|
| 4,045,263 | 8/1977 | Moore et al. | 427/8 |
| 4,359,873 | 11/1982 | Miller | 62/63 |
| 4,478,869 | 10/1984 | Brady et al. | 427/10 |
| 4,523,543 | 6/1985 | Brady et al. | 118/697 |

OTHER PUBLICATIONS

"Color Shading of Asphalt Shingle Roofs", Technical Bulletin of Asphalt Roofing Manufacturers Association (ARMA), Rockville, MD., Reprinted May 1986.

"High Resolution Goniophotometer and Its Use To Measure Appearance Properties and Light-Scattering Phenomena", by Richard S. Hunter, Modern Aspects of Reflectance Spectroscopy, Plenum Press, 1968.

"A Study of The Surface Parameters of Ground and Lapped Metal Surfaces, Using Specular and Diffuse Reflection of Laser Light", by L. H. Tanner et al. Dept. of Mechanical and Production Engineering, Brighton Polytechnic, Wear, vol. 36 (1976) pp. 299-316.

HunterLab brochure "GP-1R Goniophotometer", Reston, VA (Oct. 1987).

"Instrumental Techniques to Quantify Textural Change in Carpet", by D. J. Jose et al., Textile Research Journal, vol. 58, No. 4, Apr. 1988.

"Measurement of Granule Coverage on Bituminous Roofing Surfaces", O. Dutt, American Society for Testing and Materials, Journal of Testing and Evaluation, vol. 14, No. 3, May 1986.

"Spectral-density function gives surface roughness", John C. Stover, Laser Focus, Feb. 1976.

"High-Speed Surface Roughness Measurement", D. G. Jansson et al., Journal of Engineering for Industry, vol. 106, pp. 34-39, Feb. 1984.

"Calibration of Reflectance Standards", W. Budde, National Research Council of Canada, May 26, 1976.

"Color Science, Concepts and Methods, Quantitative Data and Formulae", Gunter Wyszecki et al., John Wiley & Sons (1982).

"Roughness characterization of smooth machined surfaces by light scattering", John C. Stover, Applied Optics, vol. 14, No. 8, Aug. 1975.

*Primary Examiner*—Terry J. Owens

*Attorney, Agent, or Firm*—Ted C. Gillespie

[57] ABSTRACT

A method of making granule-covered roofing material comprises discharging granules onto continuously moving asphaltic material, pressing the granules into the asphaltic material, directing light toward the granule-covered asphaltic material, measuring the reflected light from the granule-covered asphaltic material, and responding to the measured reflected light by modifying a process parameter to effect a change in the reflectance of light from the granule-covered asphaltic material.

20 Claims, 1 Drawing Sheet

METHOD AND APPARATUS FOR MANUFACTURING A GRANULE-COVERED ROOFING MATERIAL BY MODIFYING A PROCESS PARAMETER IN RESPONSE TO MEASURED REFLECTED LIGHT

TECHNICAL FIELD

This invention pertains to handling continuous strips of granule-coated asphaltic material, such as asphaltic material suitable for use as roofing membranes and roofing shingles. In one of its more specific aspects, this invention relates to measuring shading in the manufacture of a granule-covered roofing material.

BACKGROUND ART

A common method for the manufacture of asphalt shingles is the production of a continuous strip of asphaltic shingle material followed by a shingle cutting operation which cuts the material into individual shingles. In the production of asphaltic strip material, either an organic felt or a glass fiber mat is passed through a coater containing liquid asphaltic material containing filler at a very hot temperature to form a tacky coated asphaltic strip. Subsequently, the hot asphaltic strip is passed beneath one or more granule applicators which apply the protective surface granules to the asphaltic strip material. Typically, the granules are dispensed from a hopper at a rate which can be controlled by making manual adjustments on the hopper. A typical shingle manufacturing process continuously manufactures the shingle material in a width sufficient for cutting the material into three, four or six shingles.

Prior to the shingle cutting stage, the granules are pressed into the still warm asphalt through a granule pressing means, such as a wringer-type granule press. Subsequently, the granule-covered roofing material is cooled so that the shingle cutting operation can operate on relatively cool shingle material.

One of the problems with granule-covered asphalt shingles is the problem known as "shading". Shading is defined as the tendency of a shingled roof to have certain areas which sometimes appear darker or lighter than the surrounding areas when the roof is viewed from different angles or under different light conditions. Shading is believed to result from slight variations in texture which occur during normal shingle production. The variation in texture necessary to cause shading with black or other dark colors is so slight that it cannot normally be detected during the manufacturing process. When light is reflected from certain roofs, the appearance varies as the viewer walks past the building. The impact will depend on the position of the sun and the overall light intensity. When the sun is directly overhead the shading may disappear.

It is believed that shading is caused by variation in the surface texture, and the angle, amount and direction of light reaching the roof - and the position from which the roof is viewed. A shaded appearance can also result from over or under embedment of the granules, or from mixing products from two manufacturing plants on the same roof. In summary, shading occurs when the roof appears to have color variation when viewed from a certain angle or at a particular time of day.

Previous attempts to eliminate shading problems have not been successful. Each year, replacement of numerous roofing applications is required because of shading complaints. Although shading does not affect the durability or performance of granule-covered asphalt shingles, the optical effect of shading is a serious problem in the residential roofing market.

DISCLOSURE OF INVENTION

The present invention solves the shading problem by measuring shading during the manufacturing process, and acting in response to the measured shading variations to correct shading deficiencies. This is accomplished by directing a light toward the granule-covered asphaltic material and measuring the reflected light from the material. It has been found that when the light beam is directed at a shallow angle, such as about 20 degrees to the surface of the roofing shingle, a good indication of shading problems can be obtained.

According to this invention, there is provided a method of making granule-covered roofing material comprising discharging granules onto continuously moving asphaltic material, pressing the granules into the asphaltic material, directing light toward the granule-covered asphaltic material, measuring the reflected light from the granule-covered asphaltic material, and responding to the measured reflected light by modifying a process parameter to effect a change in the reflectance of the granule-covered asphaltic material.

In a specific embodiment of the invention, the modification of a process parameter comprises controlling the temperature of the asphaltic material prior to the discharge of the granules.

In another specific embodiment of the invention, the modification of the process parameter comprises controlling the temperature of the granule-covered asphaltic material. In yet another embodiment of the invention, the modification of a process parameter comprises controlling the pressing of the granules into the asphaltic material.

In a preferred embodiment of the invention, the light is directed toward the granule-covered asphaltic material at an angle to the surf ace within the range of from about 10 degrees to about 45 degrees. In a more preferred embodiment of the invention, the light is directed at an angle within the range of from about 15 degrees to about 35 degrees. In the most preferred embodiment of the invention, the light is directed at an angle of about 20 degrees.

In another specific embodiment of the invention, the light directed toward the granule-covered asphaltic material has a beam spread within the range of from about 5 degrees to about 30 degrees. More preferably, the light source has a beam spread within the range of from about 10 degrees to about 20 degrees. Most preferably, the light source has a beam spread of about 12 degrees.

According to this invention, there is provided apparatus for making granule-covered roofing material comprising means for discharging granules onto continuously moving asphaltic material, means for pressing the granules into the asphaltic material, a light source directed toward the granule-covered asphaltic material, means for measuring the reflected light from the granule-covered asphaltic material, and means for responding to the measured reflected light by modifying a process parameter to effect a change in the reflectance of the granule-covered asphaltic material.

BEST MODE FOR CARRYING OUT THE INVENTION

Figure 1:
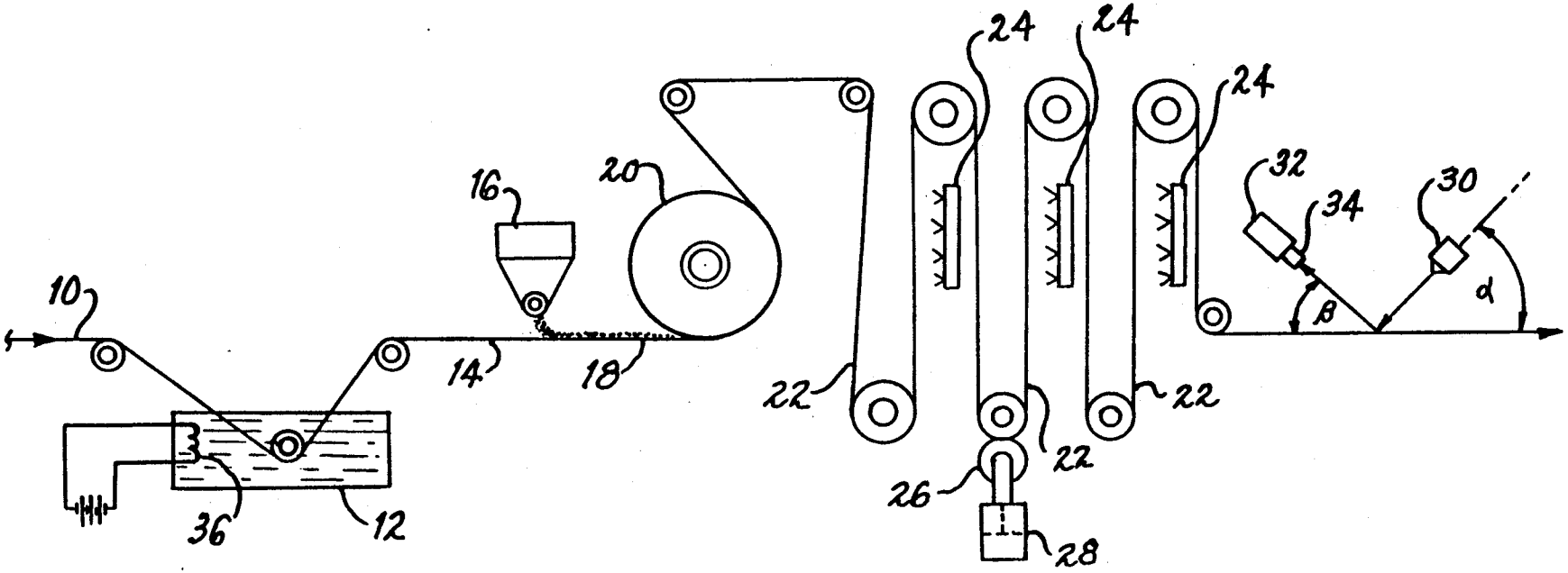
FIG. 1 is a schematic cross-sectional view in elevation of apparatus for manufacturing granule-covered roofing material according to the principles of the invention.

As shown in the drawing, base sheet 10, which can be an organic felt or a glass fiber mat, is passed through coater 12 containing-liquid asphaltic material (including filler) to create continuous hot strip 14 of asphaltic material. The tacky coated strip is then passed beneath granule hopper 16 for the discharge of granules onto the asphaltic strip to produce granule-covered asphaltic material 18.

After being covered with granules, the granule-covered asphaltic material passes around backfall drum 20 where excess granules are removed, and then moves into the cooling section where the material travels through a series of loops 22. Positioned within the loops are means for cooling the granule-covered asphaltic material, such as cooling panels 24 which can be adapted to spray air, water or a mixture of air and water onto the granule-covered asphaltic material in order to cool it. Other means for cooling the granule-covered asphaltic material are known to those skilled in the art.

Any means suitable for pressing the granules into the hot asphaltic material, such as granule press 26, can be used to set the depth of the granules in the asphalt. As shown, the granule press can be positioned within the cooling section loops, and can be operated by any suitable means, such as hydraulic cylinder 28.

After leaving the cooling section, the granule-covered asphaltic material is subjected to light from a light source such as light 30. The object of the light source is to provide light simulating daylight or sunlight. A light source which has been found to be effective is a 12 volt, 50 watt spotlight having a halogen MR16 bulb, 2 inches in diameter. Preferably, the light source is rather narrow, with a beam spread within the range of from about 5 degrees to about 30 degrees. More preferably, the beam spread is within the range of from about 10 degrees to about 20 degrees. Most preferably, the beam spread is about 12 degrees.

The light reflected from the granule-covered asphaltic material is measured or sensed by any means suitable for measuring the reflectance of light, such as photocell 32. Preferably, the photocell is adapted with a lens, such as lens 34, for focusing the light from the light source into the photocell. A suitable lens is a 50 Mm Nikon camera lens.

The light source is mounted so that the light reaches the surface of the granule-covered asphaltic material at an angle of incidence a within the range of from about 10 degrees to about 45 degrees. More preferably, the angle $\alpha$ is within the range of from about 15 degrees to about 35 degrees. Most preferably, the angle a is about 20 degrees.

It is important that the angle of incidence be set at the optimum level. The smoother the shingle surface, the greater the amount of reflected light received by the photo detector. The color of the shingle also alters the amount of light that is detected.

It has been found that the best results for measuring the reflected light are obtained when the photocell and lens are focused at an angle $\beta$ (i.e., the angle of reflectance) which is within the range of from about 5 to about 35 degrees to the surface of the shingle material. More preferably, the angle $\beta$ is within the range of from about 5 to about 20 degrees to the surface of the shingle material. Most preferably, the angle $\beta$ is about 10 degrees with respect to the surface of the shingle material. During operation, it is the relative values of reflected light, rather than the absolute value, which is the important variable to be observed. The value of the reflected light from various samples of one color should be compared with similar samples of the same color. The method and apparatus of the invention .can thereby detect short term variations in the process.

Once the reflectance of the light from a granule-covered asphaltic material is measured, a comparison is made with a reference or predetermined value of reflected light, and, if necessary, a process parameter is modified to effect a change in the reflectance of light from the granule-covered asphaltic material. Process parameters which could be changed include, but are not limited to the following: controlling or changing the temperature of the asphaltic material prior to the discharge of granules, controlling the temperature of the granule-covered asphaltic material, controlling the pressing of the granules into the asphaltic material, controlling the percent of filler in the asphaltic material, or controlling the line speed.

One of the most important uses of the invention is to control and minimize the variation from lane to lane, or in the cross-machine direction. To accomplish this, the amount of reflected light from each shingle lane can be compared to each other, and/or to a predetermined value. Adjustments to one or more process parameters are then made in response to variations in the light reflected from the various lanes in the shingle manufacturing process, thereby assuring that shingles produced at the same time from the same machine will be of the same shade.

The temperature of the asphaltic material can be controlled with any suitable means such as asphalt heater 36. The temperature of the granule-covered asphaltic material can be controlled prior to the granule press operation by means of the first few of the cooling panels. Also, the hydraulic cylinder can be actuated to control the granule pressing operation of the granule press. These are merely examples of ways of responding to the measured reflectance by modifying a process parameter to effect a change in the reflected light.

In operation, if the photocell detects variation in reflected light which would indicate that, for example, the granule-covered shingle material would appear darker to the eye on the roof, then a response could be an increase in the hydraulic cylinder pressure in order that the granule press drive the granules more deeply into the asphaltic material, i.e., make a smoother surface.

It will be evident from the foregoing that various modifications can be made to this invention. Such, however, are considered as being within the scope of the invention.

INDUSTRIAL APPLICABILITY

This invention will be found to be useful in the continuous production of asphaltic strip material for such uses as asphalt shingles.

We claim:

1. The method of making granule-covered roofing material comprising discharging granules onto continuously moving asphaltic material to form granule-covered asphaltic material, pressing the granules into the asphaltic material, directing light toward the granule-covered asphaltic material, measuring the reflected light from the granule-covered asphaltic material, and responding to the measured reflected light by modifying a process parameter to effect a change in the reflected light from the granule-covered asphaltic material.

2. The method of claim 1 in which the modification of a process parameter comprises controlling the temperature of the asphaltic material prior to the discharge of granules.

3. The method of claim 1 in which the modification of a process parameter comprises controlling the temperature of the granule-covered asphaltic material.

4. The method of claim 1 in which the modification of a process parameter comprises controlling the pressure of the pressing of the granules into the asphaltic material.

5. The method of claim 1 in which the light is directed toward the granule-covered asphaltic material at an angle to the surface of the granule-covered asphaltic material within the range of from about 10 degrees to about 45 degrees.

6. The method of claim 5 in which the light is directed toward the granule-covered asphaltic material at an angle to the surface of the granule-covered asphaltic material within the range of from about 15 degrees to about 35 degrees.

7. The method of claim 6 in which the modification of a process parameter comprises controlling the temperature of the asphaltic material prior to the discharge of granules.

8. The method of claim 6 in which the modification of a process parameter comprises controlling the temperature of the granule-covered asphaltic material.

9. The method of claim 6 in which the modification of a process parameter comprises controlling the pressure of the pressing of the granules into the asphaltic material.

10. The method of claim 1 in which the light directed toward the granule-covered asphaltic material has a beam spread within the range of from about 5 degrees to about 30 degrees.

11. The method of claim 10 in which the light directed toward the granule-covered asphaltic material has a beam spread within the range of from about 10 degrees to about 20 degrees.

12. The method of claim 1 in which the measuring step measures light having an angle of reflectance within the range of from about 5 degrees to about 20 degrees to the surface of the granule-covered asphaltic material.

13. The method of making granule-covered roofing material comprising discharging granules onto continuously moving asphaltic material to from granule-covered asphaltic material, pressing the granules into the asphaltic material, directing light toward the granule-covered asphaltic material at an angle to the surface of the granule-covered asphaltic material within the range of from about 20 degrees to about 45 degrees, the light having a beam spread within the range of from about 5 degrees to about 30 degrees, measuring the reflected light from the granule-covered asphaltic material, and responding to the measured reflected light by modifying a process parameter to effect a change in the reflected light from the granule-covered asphaltic material.

14. The method of claim 13 in which the modification of a process parameter comprises controlling the temperature of the asphaltic material prior to the discharge of granules.

15. The method of claim 13 in which the modification of a process parameter comprises controlling the temperature of the granule-covered asphaltic material.

16. The apparatus of claim 13 in which the modification of a process parameter comprises controlling the pressure of the pressing of the granules into the asphaltic material.

17. Apparatus for making granule-covered roofing material comprising means for discharging granules onto continuously moving asphaltic material to form granule-covered asphaltic material, means for pressing the granules into the asphaltic material, a light source directed toward the granule-covered asphaltic material, means for measuring the reflected light from the granule-covered asphaltic material, and means for responding to the measured reflected light by modifying a process parameter to effect a change in the reflected light from the granule-covered asphaltic material.

18. The apparatus of claim 17 in which the means for responding to the measured reflected light comprises means for controlling the temperature of the asphaltic material prior to the discharge of granules.

19. The apparatus of claim 17 in which the means for responding to the measured reflected light comprises means for controlling the temperature of the granule-covered asphaltic material.

20. The apparatus of claim 17 in which the means for responding to the measured reflected light comprises means for controlling the pressure of the pressing of the granules into the asphaltic material.

* * * * *